United States Patent [19]

Swiatosz

[11] 4,326,119

[45] Apr. 20, 1982

[54] PORTABLE BATTERY OPERATED ELECTRIC SMOKE GENERATOR

[75] Inventor: Edmund Swiatosz, Maitland, Fla.

[73] Assignee: The United States of America as represented by the Secretary of the Navy, Washington, D.C.

[21] Appl. No.: 137,226

[22] Filed: Apr. 4, 1980

[51] Int. Cl.[3] ..... B01J 13/00; F22B 1/28; H05B 3/42; B05B 1/24

[52] U.S. Cl. ..... 219/272; 43/127; 43/129; 219/275; 219/300; 219/304; 239/133; 239/136; 252/305; 252/359 R; 252/359 CG

[58] Field of Search ..... 219/300, 271–276, 219/304, 305; 239/135–138; 43/127–129; 252/305, 359 R, 359 CG; 128/203.27

[56] References Cited

U.S. PATENT DOCUMENTS

| | | | |
|---|---|---|---|
| 1,709,597 | 4/1929 | Shively . | |
| 1,968,509 | 7/1934 | Tiffany | 128/203.27 |
| 2,109,900 | 3/1938 | Cohen | 219/300 |
| 2,287,974 | 6/1942 | Cohen | 219/300 X |
| 2,311,199 | 2/1943 | Astradsson | 116/214 |
| 2,324,359 | 7/1943 | Callan | 252/305 |
| 2,914,221 | 11/1959 | Rosenthal | 219/300 X |
| 3,205,176 | 9/1965 | Tenney | 239/135 X |
| 3,366,775 | 1/1968 | Mycue | 128/203.27 |
| 3,542,610 | 11/1970 | Lane et al. . | |
| 3,581,146 | 11/1974 | Bennett | 219/300 |
| 3,707,918 | 1/1973 | Dunfee et al. . | |
| 3,835,293 | 9/1974 | McAlister | 219/300 |
| 3,969,607 | 7/1976 | Osrow et al. | 219/272 |
| 3,990,987 | 11/1976 | Rogers | 219/300 X |

*Primary Examiner*—A. Bartis

*Attorney, Agent, or Firm*—Robert F. Beers; Robert W. Adams; David S. Kalmbaugh

[57] ABSTRACT

A portable battery-powered electric smoke generator for simulating the smoke of a fire for training purposes includes a tubular housing enclosing a rechargeable battery power supply having terminals connected to the ends of a tubular metallic coil filled with a vaporizable smoke producing liquid. One end of the tubular coil communicates with a smoke discharge port at one end of the housing. The discharge port is sealed by a fusible disk and communicates with an apertured smoke release cup. An electric switch arrangement, either thermal or electronic, is provided on the housing in the circuit between the coil and power supply for energizing the tubular coil for a time sufficient to superheat the vaporizable liquid therein. The heat of the tubular coil melts the fusible disk to release the superheated liquid through the smoke release cap into the atmosphere as a vapor simulating smoke. The liquid may be mineral oil, polyethylene glycol 200 or propylene glycol.

18 Claims, 3 Drawing Figures

PORTABLE BATTERY OPERATED ELECTRIC SMOKE GENERATOR

BACKGROUND OF THE INVENTION

1. Field of the Invention

This invention relates generally to training devices. In particular, this invention relates to a training device for simulating the smoke of a fire.

2. History of the Prior Art

A wide variety of training devices are available for generating nontoxic smoke so as to teach a student, under realistic conditions, how to handle a fire. One such device of the prior art simulates smoke by utilizing steam admixed with an organic liquid so as to produce a vaporized organic liquid, and forcing the vaporized organic liquid through a narrow orifice into the atmosphere so that the vapor is rapidly chilled. While performing satisfactorily for its intended purpose of generating smoke, this device of the prior art ordinarily leaves something to be desired, especially from the standpoints of design complexity, cost effectiveness, energy utilization efficiency, and physical size.

In addition, there are commercially available a variety of smoke bombs or smoke grenades for generating smoke so as to teach the student how to handle a fire. While working well for their intended purpose of producing smoke, these devices of the prior art ordinarily leave something to be desired from the standpoints of cost effectiveness and personal safety, in that the smoke produced thereby may be highly toxic.

SUMMARY OF THE INVENTION

The subject invention overcomes some of the disadvantages of the prior art, including those mentioned above, in that it comprises a relatively simple portable battery operated smoke generator which produces a nontoxic smoke.

Included in the subject invention is a tubular housing, a direct current voltage source mounted within the tubular housing for producing a direct current, and a tubular coil mounted within the tubular housing for heating a liquid stored therein to a predetermined temperature so as to completely vaporize the liquid. Actuating means, mounted within the tubular housing, switches on the direct current voltage source, thereby allowing the direct current produced by the direct current voltage source to be supplied to the tubular coil. This, in turn, provides for the superheating of the liquid by the tubular coil, which is then released into the atmosphere as a vapor by a smoke discharge cap.

DESCRIPTION OF THE PREFERRED EMBODIMENT

Figure 1:
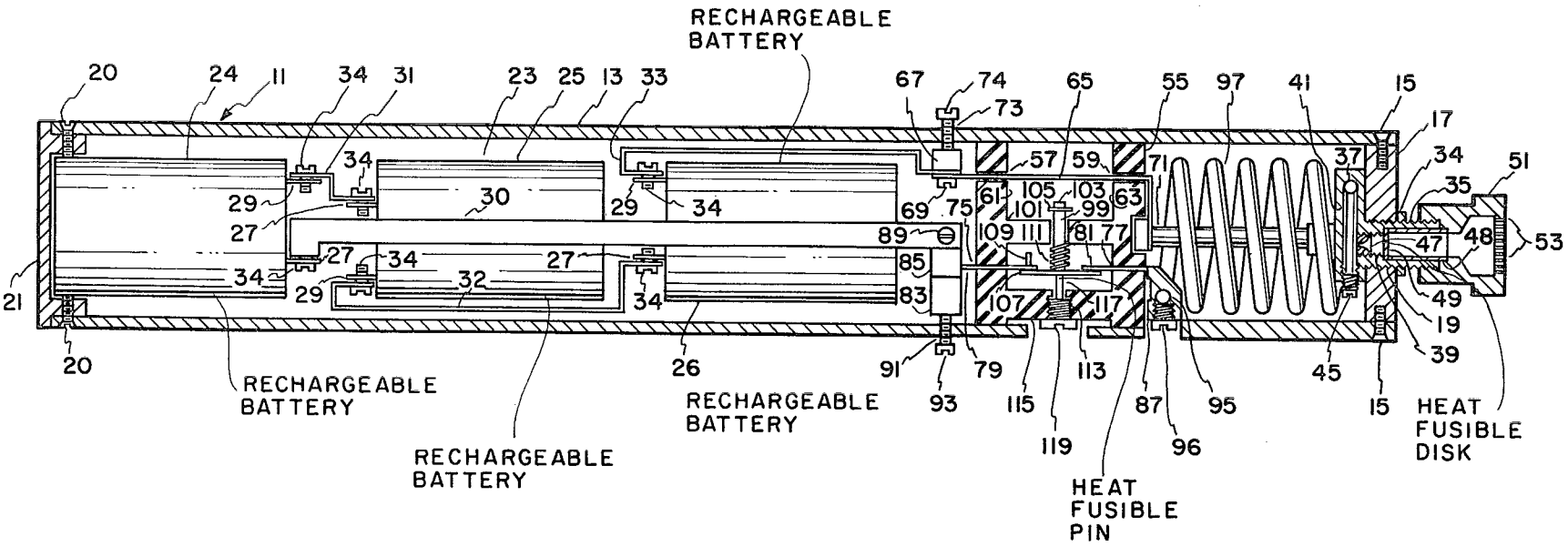
FIG. 1 is a cross-sectional view of the portable battery operated smoke generator constituting the subject invention.

The preferred embodiment of the subject invention will now be discussed in some detail in conjunction with all of the figures of the drawing, wherein like parts are designated by like reference numerals, insofar as it is practical to do so.

Referring now to FIG. 1, there is shown a portable battery operated smoke generator 11 comprising a tubular housing 13, which may be fabricated from any light weight metal alloy such as aluminum.

Fixedly attached to one end of tubular housing 13, as by a plurality of screws 15, is an end plate 17 which has passing therethrough an aperture 19. Fixedly attached to the opposite end of tubular housing 13, as by a plurality of screws 20, is an end plate 21.

Mounted within tubular housing 13 adjacent end plate 21 is a direct current voltage source 23. Direct current voltage source 23 includes a trio of rechargeable batteries 24, 25, and 26, each of which has thereon a positive terminal 27 and a negative terminal 29, and a quartet of connector strips 30, 31, 32, and 33 which are utilized to connect the trio of batteries 24, 25, and 26 in series. A plurality of screws 34 secure each of the aforementioned connector strips to the appropriate positive terminal 27 or negative terminal 29 of each of the aforementioned batteries.

At this time it may be noteworthy to mention that batteries 24, 25, and 26 may be any conventional rechargeable batteries which are commercially available from several different sources. In particular, it has been found that a sealed lead acid battery, Model 0800-0004, manufactured by Gates Energy Products of Denver, Colorado, performs quite satisfactorily as batteries 24, 25, and 26.

Screw mounted within aperture 19 of end plate 17 and secured thereto by a nut 34 is a support member 35 which has therein an intake port 37, and a discharge port 39. Extending the width of support member 35 between intake port 37 and discharge port 39 is a passageway 41 which has screw mounted on one end thereof a filler cap 45.

Screw mounted within discharge port 39 of support member 35 is an orifice 47. Positioned adjacent orifice 47 within discharge port 39 of support member 35, and secured thereto by a sleeve 48, is a heat fusible relief disk 49 which, as will be discussed more fully below, may be fabricated from a lead tin alloy. Screw mounted to the periphery of support meember 35 so as to allow for the removal therefrom is smoke release cap 51 which has therein a plurality of small apertures 53.

Mounted within tubular housing 13 as by a plurality of set screws, not shown, is a switch support frame 55 which may be fabricated from an insulating material such as ceramic filled plastic. Mounted through a pair of oppositely disposed holes 57 and 59 in a pair of oppositely disposed walls 61 and 63 of switch support frame 55 is a connector strip 65. Connector strip 65 is connected at one end thereof to a battery charger fitting 67 and connector strip 33 by a screw 69, and at the opposite end thereof to support member 35 by a bolt 71. Passing through an aperture 73 in tubular housing 13 and screw mounted into battery charger fitting 67 is a terminal screw 74.

Mounted through a pair of oppositely disposed holes 75 and 77 in oppositely disposed walls 61 and 63 of switch support frame 55 are a pair of connector strips 79 and 81, the first of which is connected to a battery charger fitting 83, and a connector strip 85 by a screw, not shown, and the second of which is connected to a coil support member 87 by conventional means such as a spot weld. Connector strip 85 is, in turn, connected to connector strip 30 by a screw 89.

Passing through an aperture 91 in tubular housing 13 and screw mounted into battery charger fitting 83 is a terminal screw 93. As will be discussed more fully below, terminal screws 74 and 93 may be utilized to connect a battery charger, not shown, to batteries 24, 25, and 26 so as to allow for the recharging of the aforementioned batteries.

Screw mounted within an aperture 95 of coil support 87 is a filler cap 96. Connected to aperture 95 of coil support 87 is one end of a tubular coil 97, the opposite end of which is connected to intake port 37 of support member 35. Stored within tubular coil 97 is a liquid, such as, for example, propylene glycol, which when vaporized simulates smoke.

At this time it may be noteworthy to mention that coil 97 may be fabricated from any highly electrical resistant metal alloy such as stainless steel.

Mounted through an aperture 99 of a connecting wall 101 of switch support frame 55 is a heat actuated switch 103 which has at one end thereof a bumper element 105, and at the opposite end thereof a cross member 107. Attached to one end of cross member 107 is a guide rod 109 which passes through an aperture, not shown, within connector strip 79. Positioned between cross member 107 and connecting wall 101 of switch support frame 55 is a compression spring 111. Mounted within an aperture 113 of a connecting wall 115 of switch support frame 55 and extending to cross member 107 of heat actuated switch 103 is a heat fusible actuator rod 117 which, as will be discussed more fully below, may be fabricated from a lead tin alloy. Screw mounted into aperture 113 of connecting wall 115 so as to force heat fusible actuator rod 117 against heat actuated switch 103, is an actuator cap 119.

Figure 2:
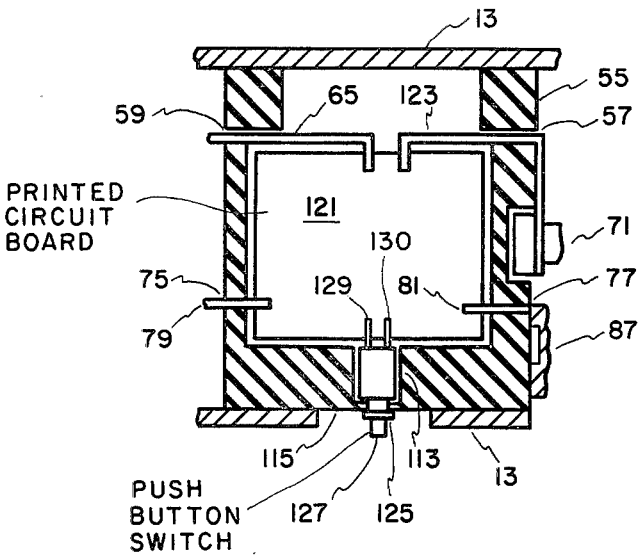
FIG. 2 is a cross-sectional view of a modified form of the actuating means of FIG. 1.
Figure 3:
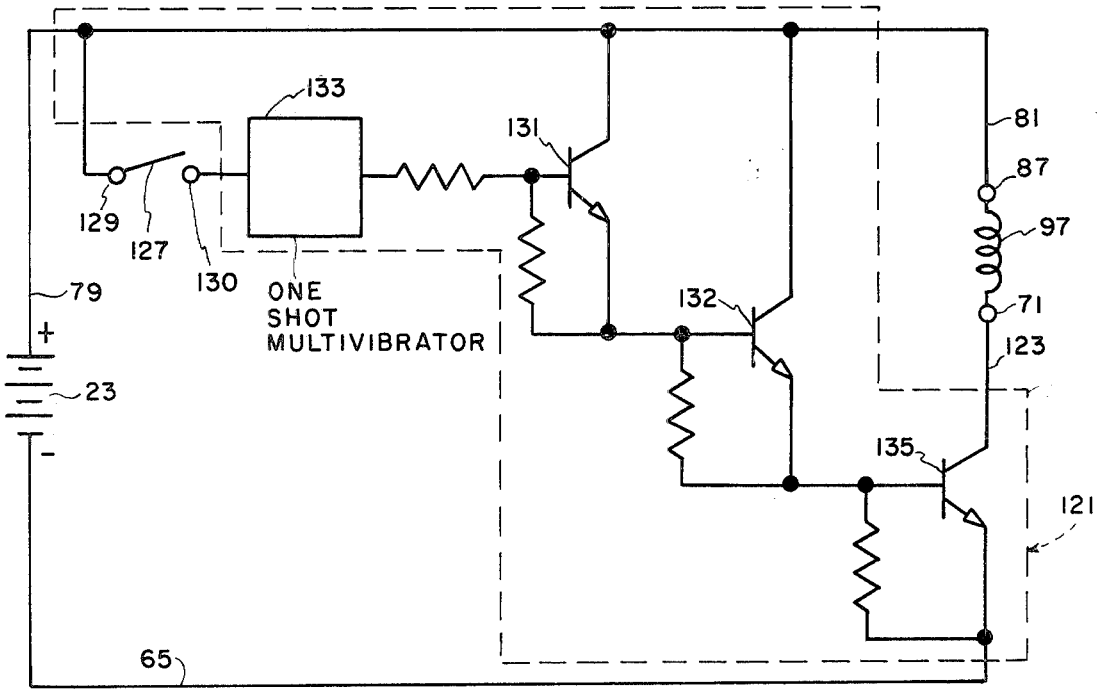
FIG. 3 is an electrical schematic of the actuating means depicted in FIG. 2.

Referring now to FIG. 2, there is shown a modified form of the subject invention wherein a printed circuit board 121 having thereon the electronic components of the circuit of FIG. 3, is mounted within switch support frame 55. Connected to printed circuit board 121 are connector strips 65, 79, 81, and 123, the last mentioned of which is connected to support 35, FIG. 1, by bolt 71. Mounted within aperture 113 of connecting wall 115 and secured thereto by a nut 125 is a normally open push button switch 127 which has thereon a pair of terminals 129 and 130 connected to printed circuit board 121.

Referring now to FIG. 3, there is shown an electrical schematic of the modified form of the subject invention illustrated in FIG. 2. The positive terminal of direct current voltage source 23 is connected to terminal 129 of normally open push button switch 127, the collectors of NPN transistors 131 and 132, and one end of tubular coil 97. Terminal 130 of normally open push button switch 127 is connected to the input of a one-shot multivibrator 133, the output of which is connected to the base of NPN transistor 131. The emitter of NPN transistor 131 is, in turn, connected to the base of NPN transistor 132, the emitter of which is connected to the base of an NPN transistor 135, with the collector thereof connected to the opposite end of tubular coil 97. The emitter of NPN transistor 135 is, in turn connected to the negative terminal of direct current voltage source 23.

The operation of the subject invention will now be discussed in conjunction with all of the figures of the drawing.

Referring now to FIG. 1, portable battery operated smoke generator 11 is activated by inserting into aperture 113 of switch support frame 55, heat fusible actuating rod 117, and then screw mounting actuator cap 119 into aperture 113 so as to force cross member 107 of heat actuated switch 103 against connector strips 79 and 81. This allows the direct current provided by direct current voltage source 23 to pass through heat actuated switch 103 to tubular coil 97 so as to heat coil 97 and the propylene glycol stored therein to a superheated temperature of approximately 450° F., thus raising the pressure of the propylene glycol to approximately forty pounds per square inch.

Heat from tubular coil 97 is then transferred through support member 19 to heat fusible relief disk 49, thus melting the aforementioned heat fusible relief disk. This, in turn, allows the superheated propylene glycol to pass through orifice 47 and the small apertures 53 of smoke release cap 51 into the atmosphere as a vapor.

In addition, heat from tubular coil 97 is transferred through coil support 87, connector strip 81, and cross member 107 of heat actuated switch 103 to heat fusible actuator rod 117, so as to melt the aforementioned heat fusible actuator rod. Compression spring 111 then opens heat actuated switch 103, thereby preventing the direct current provided by direct current voltage source 23 from being supplied to tubular coil 97.

While propylene glycol is the preferred smoke producing agent to be utilized by portable battery operated smoke generator 11, it is contemplated that other liquids such as polyethylene glycol 200 or mineral oil may be employed as the smoke producing agent for the subject invention. The utilization of a variety of smoke producing agents within the subject invention, in turn, will require that the temperature, and thus the heat transfer rate, of tubular coil 97 be either increased or decreased, depending upon the vaporization point of the liquid stored therein. This, then, contemplates that a number of integral components of the subject invention be modified in accordance with the vaporization point of the liquid stored within tubular coil 97.

Thus, for example, utilization of a smoke producing agent such as polyethylene glycol 200, which has a higher vaporization temperature than propylene glycol, by portable battery operated smoke generator 11 may require that direct current voltage source 23 increase the current supplied to tubular coil 97. In addition, as mentioned above, heat fusible relief disk 49 and heat fusible actuator rod 117 are fabricated from a lead tin alloy which, depending upon the percentage of lead and the percentage of tin therein, determines the melting point of heat fusible relief disk 49 and heat fusible actuator rod 117. This, in turn, requires that heat fusible relief disk 49 and heat fusible actuator rod 117 be fabricated in accordance with the vaporization temperature of the smoke producing agent utilized by portable battery operated smoke generator 11.

Referring now to FIGS. 1 and 3, activation of normally open push button switch 127 triggers one-shot multivibrator 133 which produces at the output thereof a logic pulse having a predetermined pulse width. The logic pulse produced by one-shot multivibrator 133 is then supplied to NPN transistor 131 so as to switch on the aforementioned NPN transistor. This, in turn, switches on NPN transistor 132 which switches on NPN transistor 135 so as to allow the direct current provided by direct current voltage source 23 to pass through tubular coil 97.

As discussed previously, the flow of current through tubular coil 97 heats coil 97 so as to vaporize the liquid stored therein and thus produce simulated smoke which passes through smoke discharge cap 51 into the atmosphere.

As mentioned above, batteries 24, 25, and 26 may be recharged by connecting a battery charger, not shown, such as Model No. HL2-6A, manufactured by Gates Energy Products, Inc. of Denver, Colorado, to terminal screws 74 and 93 of smoke generator 11. In addition, tubular coil 97 may be refilled with propylene glycol or any other suitable smoke producing agent, and heat fusible relief disk 49 and heat fusible actuator rod 117 may be replaced. These unique features of portable battery operated smoke generator 11, in turn, allow for the reutilization thereof as a training device for simulating the smoke of a fire.

From the foregoing, it may readily be seen that the subject invention comprises a new, unique, and exceedingly useful portable battery operated smoke generator which constitutes a considerable improvement over the known prior art. Obviously, many modifications and variations of the present invention are possible in light of the above teachings. It is, therefore, to be understood that within the scope of the appended claims the invention may be practiced otherwise than as specifically described.

What is claimed is:

1. A portable battery operated smoke generator comprising, in combination:

a tubular housing having a first end plate at one end thereof, and a second end plate at the opposite end thereof, said first end plate having an aperture therein;

current source means mounted within said tubular housing adjacent said second end plate and having positive and negative terminals for producing a direct current;

tubular coil means mounted within said tubular housing adjacent said first end plate and having a closed end and an open end, with the open end thereof communicating with the aperture of the first end plate of said tubular housing, said tubular coil means being adapted for superheating a vaporizable smoke producing liquid stored therein to a predetermined temperature;

said tubular coil means having the closed end thereof connected to the positive terminal of said current source means and the open end thereof connected to the negative terminal of said current source means by electrical connection means;

said electrical connection means including switching means for energizing said tubular coil means from said current source means for a period of time sufficient to superheat the vaporizable smoke producing liquid stored in said tubular coil means; and smoke discharging means connected to the open end of said tubular coil means and extending through the aperture of said first end plate for releasing said superheated liquid into the atmosphere as a vapor, said smoke discharging means having therein a heat fusible relief disk adapted for sealing the vaporizable smoke producing liquid within said tubular coil means until such time as the aforesaid vaporizable smoke producing liquid is superheated by the current flowing through said tubular coil means.

2. The portable battery operated smoke generator according to claim 1, wherein said current source means comprises a plurality of batteries connected in series.

3. The portable battery operated smoke generator according to claim 1, wherein said coil means is fabricated of stainless steel tubing.

4. The portable battery operated smoke generator according to claim 1, wherein said liquid is propylene glycol.

5. The portable battery operated smoke generator according to claim 1, wherein said liquid is polyethylene glycol 200.

6. The portable battery operated smoke generator according to claim 1, wherein said liquid comprises mineral oil.

7. The portable battery operated smoke generator according to claim 1, wherein said switching means for energizing said tubular coil means from said current source means comprises:

a switch support frame mounted within said tubular housing;

a heat actuated switch mounted within said switch support frame, said heat actuated switch having a cross member, one end of which is connected to the positive terminal of said current source means, and the opposite end of which is connected to the closed end of said coil means;

a connector strip mounted within said tubular housing, said connector strip effectively connected between the negative terminal of said current source means and the open end of said coil means.

8. The portable battery operated smoke generator according to claim 1, wherein said switching means for energizing said tubular coil means from said current source means comprises:

a normally open switch having an input terminal connected to the positive terminal of said current source means and the closed end of said tubular coil means, and an output terminal;

a one-shot multivibrator having an input connected to the output terminal of said normally open switch and an output;

a first transistor having an emitter, a base connected to the output of said one-shot multivibrator, and a collector connected to the positive terminal of said current source means and the closed end of said tubular coil means;

a second transistor having an emitter, a base connected to the emitter of said first transistor, and a collector connected to the positive terminal of said current source means and the closed end of said tubular coil means; and a third transistor having a base connected to the emitter of said second transistor, a collector connected to the open end of said coil means, and an emitter connected to the negative terminal of said current source means.

9. The portable battery operated smoke generator according to claim 8, wherein said first, second, and third transistors are NPN transistors.

10. The portable battery operated smoke generator according to claim 1, wherein said smoke discharging means comprises:

a support member mounted within and extending through the aperture of said first end plate, said support member having an intake port connected to the other end of said coil means, and a discharge port;

an orifice mounted within the discharge port of said support member;

said heat fusible relief disk positioned within the discharge port of said support member adjacent said orifice; and a smoke release cap coupled to the periphery of said support member so as to allow the removal of said smoke release cap from said support member, said smoke release cap having a plurality of small apertures in alignment with the discharge port of said support member.

11. A portable smoke producing device comprising, in combination:

a tubular housing having an aperture near the center thereof, a first end plate at one end thereof, and a second end plate at the opposite end thereof, said first end plate having an aperture therein;

a direct current voltage source mounted within said tubular housing adjacent said second end plate, said direct current voltage source having positive and negative terminals adapted for providing a direct current;

a tubular coil mounted within said tubular housing adjacent said first end plate, said tubular coil having one end thereof connected to the positive terminal of said direct current voltage source;

a vaporizable smoke producing liquid stored within said tubular coil;

a normally open manually actuable switch mounted within the aperture of said tubular housing, said normally open switch having an input terminal connected to the positive terminal of said direct current voltage source and an output terminal;

a one-shot multivibrator having an input connected to the output terminal of said normally open switch and an output;

a first transistor having an emitter, a base connected to the output of said one-shot multivibrator, and a collector connected to the positive terminal of said direct current voltage source;

a second transistor having an emitter, a base connected to the emitter of said first transistor, and a collector connected to the positive terminal of said direct current voltage source;

a third transistor having a collector connected to the other end of said tubular coil, a base connected to the emitter of said second transistor, and an emitter connected to the negative terminal of said direct current voltage source;

a support member mounted within and extending through the aperture of said first end plate, said support member having a discharge port and an intake port connected to the other end of said tubular coil;

an orifice mounted within the discharge port of said support member;

a heat fusible relief disk positioned within said support member so as to seal the other end of said tubular coil until such time as the vaporizable smoke producing liquid therein is superheated by the current flow through said coil; and a smoke release cap coupled to the periphery of said support member so as to allow the removal of said smoke release cap from said support member, said smoke release cap having a plurality of small apertures in alignment with the discharge port of said support member.

12. The portable smoke producing device of claim 11, wherein said liquid comprises propylene glycol.

13. The portable smoke producing device of claim 11, wherein said liquid comprises polyethylene glycol 200.

14. The portable smoke producing device of claim 11, wherein said liquid comprises mineral oil.

15. A smoke generating device comprising, in combination:

a tubular housing having an aperture near the center thereof, a first end plate at one end thereof, and a second end plate at the opposite end thereof, said first end plate having an aperture therein;

current source means mounted within said tubular housing adjacent said second end plate, and having positive and negative terminals for producing a direct current;

tubular coil means mounted within said tubular housing adjacent said first end plate and having a closed end and an open end, with the closed end thereof connected to the positive terminal of said current source means, and with the open end thereof communicating with the aperture of the first end plate of said tubular housing, and effectively connected to the negative terminal of said current source means, said tubular coil means being adapted for superheating a vaporizable smoke producing liquid stored therein to a predetermined temperature;

manually actuated normally open switching means mounted within the aperture of said tubular housing, said manually actuated normally open switching means having a first terminal connected to the positive terminal of said current source means, and a second terminal for allowing the direct current produced by said current source means to pass therethrough upon the closure thereof;

one-shot multivibrator means having an input connected to the second terminal of said manually actuated normally open switching means and an output for providing a logic pulse at the output thereof in response to the closure of said manually actuated normally open switching means;

a first transistor having an emitter, a base connected to the output of said one-shot multivibrator, and a collector connected to the positive terminal of said current source means;

a second transistor having an emitter, a base connected to the emitter of said first transistor, and a collector connected to the positive terminal of said current source means;

a third transistor having a collector connected to the closed end of said tubular coil means, a base connected to the emitter of said second transistor, and an emitter connected to the negative terminal of said current source means;

said first, second, and third transistors to be switched on when the logic pulse provided by said one-shot multivibrator means is applied to the base of said first transistor so as to allow the current provided by said current source means to flow through said tubular coil means, and thereby superheat the vaporizable liquid stored within said tubular coil means; and smoke discharging means connected to the open end of said tubular coil means and extending through the aperture of said first end plate for releasing said superheated liquid into the atmosphere as a vapor, said smoke discharging means having therein a heat fusible relief disk adapted for sealing the vaporizable smoke producing liquid within said tubular coil means until such time as the aforesaid vaporizable smoke producing liquid is superheated by the current flowing through said tubular coil means.

16. The smoke generating device according to claim 15, wherein said current source means comprises a plurality of batteries connected in series.

17. The smoke generating device according to claim 15, wherein said liquid is propylene glycol.

18. The smoke generating device according to claim 15, wherein said smoke discharging means comprises:

a support member mounted within and extending through the aperture of said first end plate, said support member having an intake port connected to the other end of said coil means, and a discharge port;

an orifice mounted within the discharge port of said support member;

said heat fusible relief disk positioned within the discharge port of said support member adjacent said orifice; and a smoke release cap coupled to the periphery of said support member so as to allow the removal of said smoke release cap from said support member, said smoke release cap having a plurality of small apertures in alignment with the discharge port of said support member.

* * * * *